US007580533B2

(12) United States Patent
Schwartz

(10) Patent No.: US 7,580,533 B2
(45) Date of Patent: Aug. 25, 2009

(54) PARTICULATE FLOW DETECTION MICROPHONE

(76) Inventor: David M. Schwartz, 21 Madera Ave., San Carlos, CA (US) 94070

( * ) Notice: Subject to any disclaimer, the term of this patent is extended or adjusted under 35 U.S.C. 154(b) by 862 days.

(21) Appl. No.: 11/140,051

(22) Filed: May 31, 2005

(65) Prior Publication Data

US 2006/0182300 A1 Aug. 17, 2006

Related U.S. Application Data

(60) Provisional application No. 60/653,133, filed on Feb. 16, 2005.

(51) Int. Cl.

| | |
|---|---|
| ***H04R 25/00*** | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |

(52) U.S. Cl. ..... 381/172; 381/355; 381/369

(58) Field of Classification Search ..... 381/172, 381/355; 385/7

See application file for complete search history.

(56) References Cited

U.S. PATENT DOCUMENTS

| | | | | |
|---|---|---|---|---|
| 3,941,477 | A * | 3/1976 | Schodl | 356/28 |
| 4,166,932 | A | 9/1979 | Selway | |
| 4,249,244 | A * | 2/1981 | Shofner et al. | 250/573 |
| 4,381,153 | A * | 4/1983 | Bohl et al. | 356/437 |
| 4,412,105 | A | 10/1983 | Muscatell | |
| 4,479,265 | A | 10/1984 | Muscatell | |
| 4,498,333 | A | 2/1985 | Parthasarathy | |
| 4,655,086 | A | 4/1987 | Mielnicka-Pate et al. | |
| 4,689,827 | A | 8/1987 | Gurney, Jr. | |
| 4,979,820 | A | 12/1990 | Shakkottai et al. | |
| 5,159,843 | A * | 11/1992 | Shakkottai et al. | 73/24.05 |
| 5,262,884 | A | 11/1993 | Buchholz | |
| 5,296,910 | A | 3/1994 | Cole | |
| 5,617,212 | A * | 4/1997 | Stuart | 356/438 |
| 5,785,403 | A | 7/1998 | Chang | |
| 5,810,213 | A * | 9/1998 | Flores et al. | 222/610 |
| 6,014,239 | A | 1/2000 | Veligdan | |
| 6,055,080 | A | 4/2000 | Furstenau et al. | |
| 6,072,882 | A | 6/2000 | White et al. | |
| 6,147,787 | A * | 11/2000 | Veligdan | 398/133 |
| 6,154,551 | A | 11/2000 | Frenkel | |
| 6,301,034 | B1 | 10/2001 | Speciale | |
| 6,483,619 | B1 | 11/2002 | Greywall | |
| 6,590,661 | B1 | 7/2003 | Shnier | |
| 6,598,853 | B1 | 7/2003 | Appleford et al. | |
| 6,661,897 | B2 * | 12/2003 | Smith | 381/67 |
| 2003/0016838 | A1 | 1/2003 | Paritsky et al. | |

* cited by examiner

*Primary Examiner*—Brian Ensey
*Assistant Examiner*—Matthew Eason
(74) *Attorney, Agent, or Firm*—Shoemaker and Mattare, Ltd

(57) ABSTRACT

Gas containing particles or droplets flowing continuously through a microphone is perturbed by sound waves. Sound-induced localized pressure changes in the gas are measured by detecting variations in gas opacity with an optical transducer disposed transverse to the flow direction.

4 Claims, 8 Drawing Sheets

PARTICULATE FLOW DETECTION MICROPHONE

This application claims priority benefit of provisional patent application 60/653,133, filed Feb. 16, 2005.

BACKGROUND OF THE INVENTION

All modern microphones utilize a membrane or a solid plate as a diaphragm to absorb acoustical energy from sound pressure waves. That energy is then converted to electrical impulses or digital signals by a variety of means, depending on the microphone design. The impulses or signals are then stored or transmitted for immediate or later reproduction by headphones or loudspeakers.

The diaphragm or flat plate introduces distortions, non-linear effects, and attenuation into the signal. This is the inevitable consequence of the physical nature of the device. While sound waves travel in only one direction from the source (reflected energy from other surfaces complicates the situation), the diaphragm or plate must travel in two directions, forward and back, in order to maintain its position in the microphone housing. This undesirable bi-directional operation inherent in traditional microphone design is remedied with the present invention.

There are a number of U.S. Patents that disclose methods for detecting sound waves in air by using lasers and other optical methods, attempting to detect the change in density of the airflow caused by sound pressure waves, or indirectly by measuring the deflection of a surface responding to the pressure waves. The prior art includes the following patents: U.S. Pat. No. 6,301,034, U.S. Pat. No. 6,147,787, U.S. Pat. No. 5,785,403, U.S. Pat. No. 4,479,265, U.S. Pat. No. 4,412,105, U.S. Pat. No. 6,598,853, U.S. Pat. No. 6,483,619, U.S. Pat. No. 6,154,551, U.S. Pat. No. 6,055,080, U.S. Pat. No. 6,014,239, U.S. Pat. No. 5,262,884, and U.S. Pat. No. 4,166,932.

The measurement of smoke density in a flue is common within industrial facilities to monitor pollutants and process state. Smoke density in exhaust pipes is also commonly measured to evaluate the performance of diesel engines.

Current microphone technology has two fundamental and irreducible problems: (1) the diaphragm or plate that detects sound pressure waves has a finite mass; and (2) as a consequence, the diaphragm or plate takes a finite amount of time to respond to changes in sound wave pressure.

These two problems are a source of non-linear response and loss of audio information by the microphone. These non-linearities and losses are difficult to quantify for the simple reason that the detection methods used to study these problems contain the same flawed transducers they are attempting to measure.

For the sake of illustrating the nature of the non-linearities and losses of a conventional microphone, consider the case where a 2,000 Hz steady-state audio tone is suddenly changed to a 4,000 Hz tone at half the volume. For this change to be accurately recorded, the output signal must change to its new state within 0.00025 seconds. Within that period of time, the diaphragm, membrane or plate and any attached metal coil or magnet inside the microphone capsule must increase its linear speed by a factor of two, and at the same time reduce its linear excursion (travel) by half. In fact, there are no physical transducer systems that can accomplish this; all systems with mass necessarily have some hysteresis effects.

Depending on the mass of the moving elements in the microphone, the actual transition from old to new output signal will be on the order of ten times the period required to avoid distortion and signal loss. Consequently, for the duration of time it takes for the microphone to respond to the new signal and have no remnants of the previous signal, the new 4,000 Hz signal is corrupted in both frequency and amplitude by the microphone's physical "memory" of the discontinued 2,000 Hz signal. In real-life situations, where the input sound waves are constantly changing, this problem is exacerbated. Listeners perceive this problem as the part of the difference between recorded audio and live audio. The goal of the present invention is to reduce that perceived difference as much as possible.

SUMMARY OF THE INVENTION

An object of the invention is to provide a microphone which has faster dynamic response than conventional microphones. This and other objects are satisfied by the microphone and method described below.

In place of the diaphragm or plate in a conventional microphone, the present invention uses a continuous stream of a partially transparent compressible medium, preferably a dispersion of microscopic particles or droplets in air or a combination of gases. The stream may be hot or cold, depending on its composition. The nozzle from which the medium flows, and the chamber through which is flows, may be designed to maintain laminar flow of the stream, but we have found that turbulent flow also produces interesting results. The stream may be recovered and re-used or not, depending on the specific design of the microphone.

The medium stream within the microphone housing is disturbed whenever sound pressure waves impinge on it. Because the stream or jet is constantly renewed and has little mass, the displacement of the stream is linearly proportional to the sound waves impinging on it and does not have any elasticity, or consequent bi-directional movement.

Detection of the displacement of the stream or jet is preferably by photo-optical means. The beam of light from an optical emitter, such as an LED, is detected by a photocell opposite the emitter, with the stream or jet in the gap between them.

The partially transparent medium stream is like a column of smoke rising from a small fire. On opposite sides of the column are the light emitter and the photocell light detector. Speaking close to the column will cause the smoke to be disturbed by the sound pressure waves in the ambient air, which in turn were caused by air leaving the speaker's lungs, modulated by vocal chords and mouth.

The present invention is a replacement for conventional microphones used in audio applications such as music studios, television studios, live performances, conferences, and address systems. It provides a new method of converting sound pressure waves in air to electrical signals suitable for recording, amplification or broadcast.

With this invention, the problems of transducer mass and its hysteresis are eliminated because the particle-bearing gas flow is constantly renewed at a rate far in excess of the rate at which sound pressure waves change state.

DESCRIPTION OF THE PREFERRED EMBODIMENT(S)

Figure 1:
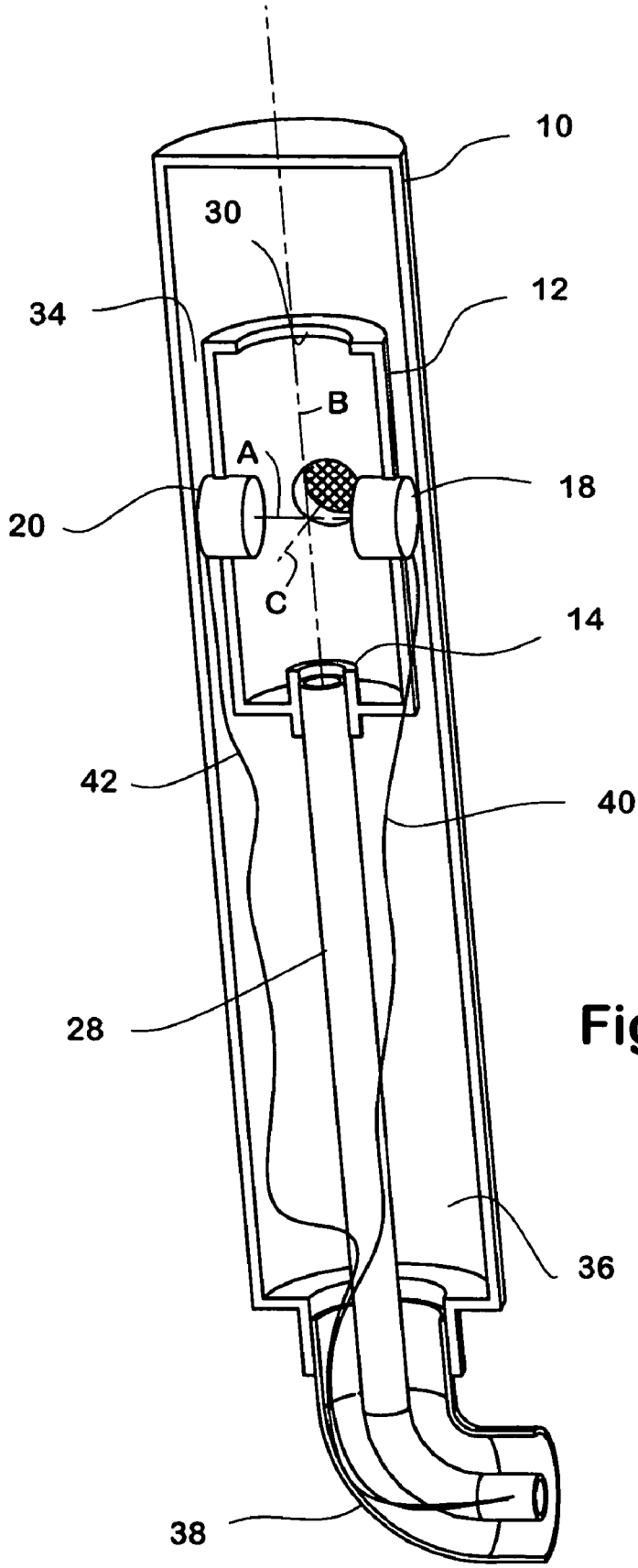
FIG. 1 is a perspective view of a microphone embodying the invention.
Figure 2:
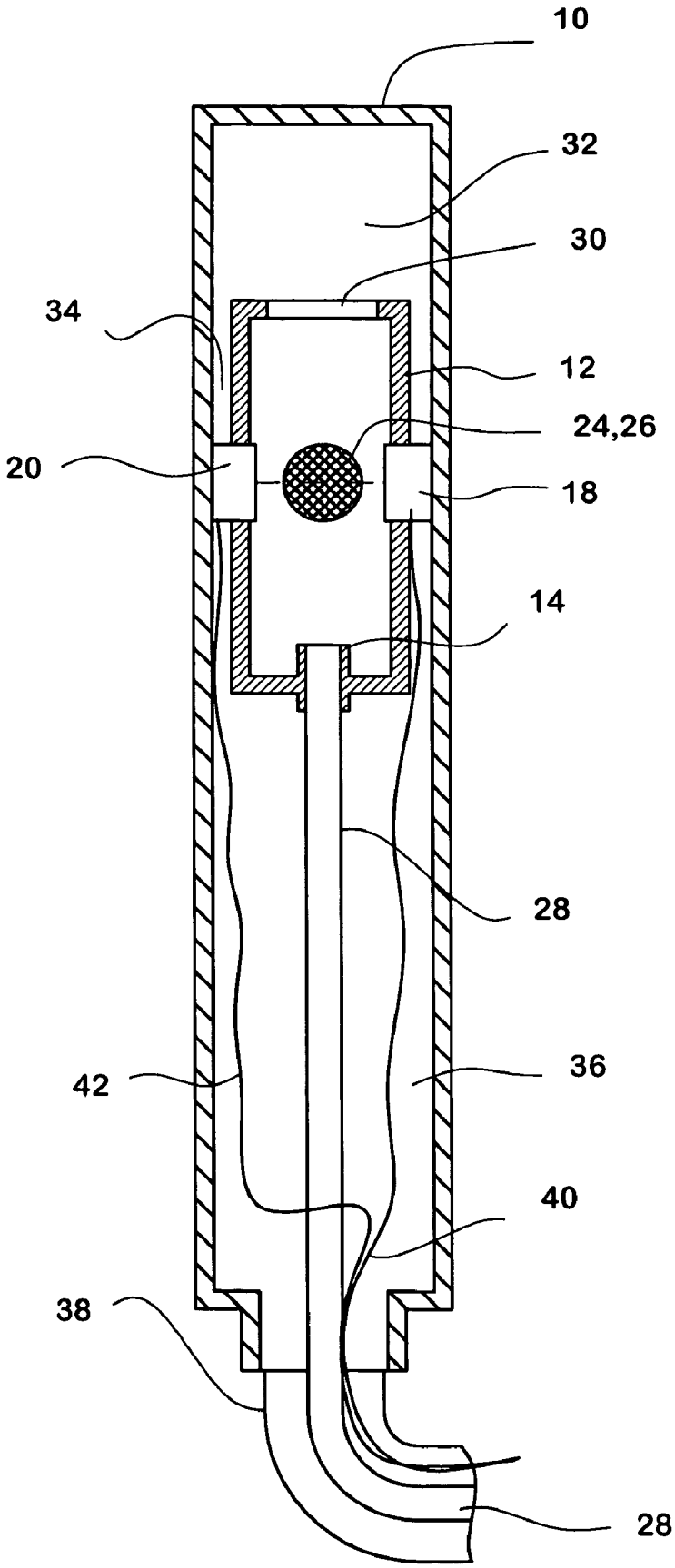
FIG. 2 is a sectional view thereof, taken on a diametric plane.

As shown in FIGS. 1 and 2, a particulate flow detection microphone includes a housing 10 containing a detection chamber 12, a particle-bearing gas nozzle 14, and a laser/photo-sensor pair 18,20. The interior surface of the detection chamber may be coated or covered with a sound-absorbing material to minimize confusing sound reflection within the chamber.

The source and detector are aligned on an axis "A" transverse to the common longitudinal axis "B" of the microphone and of the inner cylindrical detection chamber 12. The source and detector extend through the wall of the detection chamber. To admit sound to the detection chamber, the housing and the detection chamber have apertures 24,26 at locations 90° from the light source and detector; the openings are aligned on an axis "B" perpendicular to axis "A". Both of these axes are perpendicular to the longitudinal axis "C" of the housing; thus, the axes A, B and C are orthogonal.

A small duct extends between the walls of the housing and detection chamber, providing a sound path which is isolated from the annular space between the housing and the detection chamber. A supply conduit 28 terminating at a nozzle 14 introduces particle- or droplet-containing gas into the chamber at one end; the gas passes in direction "C" (along the longitudinal axis of the housing) through the chamber and escapes through the hole 30 at the other end into the upper plenum 32. The gas leaves the housing by flowing down through the annular space 34 between the housing and the detection chamber, and through the lower plenum 36 to a return conduit 38 coaxial with the supply conduit 28. The conduits are flexible below the bottom of the housing.

Electrical conductor wires 40,42 extend from the transducer 18 and detector 20, respectively, through the annular space 34 to the return conduit 36.

In operation, a steady-state flow of small light-obstructing particles or droplets, preferably having a diameter in the range of 1 to 3 microns, is dispersed in a compressible medium such as air. The particles or droplets render the medium partially transparent. The medium is introduced into the microphone housing 10 through the nozzle 14 at the bottom of the detection chamber. The nozzle and the housing may be designed to maintain laminar flow of the medium through the chamber; however, I have found that turbulent medium may also be useful. The difference between laminar and turbulent flow is the nature of the noise floor and the granularity of the noise itself. By deliberately generating a highly turbulent flow, one may be able to produce a "whiter," more random noise floor or one in which the noise is mainly high frequency, where it has a less perceptible effect on audio. The signal processor can then focus better on correlated signals easier.

Whether laminar or turbulent, the flow rate should be sufficiently great that "clean" undisturbed medium is available at the photo-sensor at all times. On one side of the chamber, at a right angle to the flow, the light source 18, preferably a laser, is directed across the flow of medium. The light source may emit light in the visible or invisible (infrared or ultraviolet) ranges. On the opposite side of the chamber, 180° from the laser, the photo-sensor 20 is aligned with the laser beam source.

In the absence of any sound pressure waves at the aperture of the microphone housing, the laser beam is uniformly obstructed by the particle flow and the opposing photo-sensor detects a constant signal. When sound is present, the flowing medium is perturbed by pressure waves, causing the intensity of the beam striking the photosensor to vary. The medium stream may form a narrow ribbon, with the laser beam directed at the narrow edge of the ribbon, so that transverse displacement of the ribbon, into and out of the beam, may be sensed. Alternatively, the medium stream may be so wide that it is never displaced out of the beam, in which case changes in transparency of the medium (which becomes less transparent when it is compressed and the particles are closer together) are sensed.

Whatever the sensing mode, the photosensor output is modulated. The electrical output signal of the photo-sensor is linearly proportional to the disturbance of the particle-bearing gas flow, which in turn is the direct result of the interaction of sound pressure waves with the gas medium. Thus the output of the photo-sensor is a faithful and exact analog of the sound pressure waves.

Some ambient air may be drawn into the microphone, or some medium may escape via the housing apertures, even if screens are used. One of the parameters that the control circuit has to monitor and control is the volumetric flow rate of the system. If inlet and exhaust rates are perfectly balanced, with the amount of medium delivered and the amount being returned to the base unit identical, medium leakage or air infiltration at the microphone housing is minimized. The physical design parameters which may be adjusted to optimize performance include the housing diameter, the detection chamber diameter, shape and volume, the nozzle shape and size, the laser's beam diameter and lens shape, the photodetector's size and lens shape, the size and shape of the microphone housing apertures, and the aperture screen density or resistance to air flow.

The nozzle and chamber are designed to maintain laminar flow of the medium crossing the laser beam. The flow rate should be sufficient to always present a smooth (low-noise) surface on which the sound signal can "write". The sound pressure waves impinge on the medium, causing a disturbance which is linearly proportional to the amplitude of the sound pressure. If the flow rate of the medium is not fast enough, internal reflections and new incoming waves will be confused to the extent that no amount of signal processing can recover a true signal from the raw data. Determination of the optimum flow rate is a matter of routine experimentation.

The screens, one at the entry aperture to the microphone and one at the exit aperture, control how much of external sound is admitted to the chamber, and how much is reflected at the entry aperture, as well as how much back pressure is maintained inside the housing. The material of the screens is a matter of design choice; for example, a porous foam may work better than a rigid mesh. In some situations, the screens may be entirely omitted.

It should be noted that, while a chamber within a housing is presently thought to be the best mode of the invention, it may not be necessary to have a separate internal chamber, and in fact it is possible that the invention could be practiced with no enclosure whatsoever.

In the case where only a single housing is used, medium may be introduced at one end of the housing and exhausted at the other end.

In operation, particle- or droplet-containing gas medium enters the flexible supply tube, and is injected into the detection chamber by a nozzle. The medium is penetrated by the beam generated by the laser source, and the beam intensity is detected by the photosensor receiver. The electrical signal from the sensor is conducted by electrical wiring containing multiple conductors (power, ground, gain, signal out). It is possible the photosensor output could be other than electrical (e.g., optical) and that this optical signal could be subsequently processed. That alternative could be particularly useful for hand-held versions of the invention.

Figure 3:
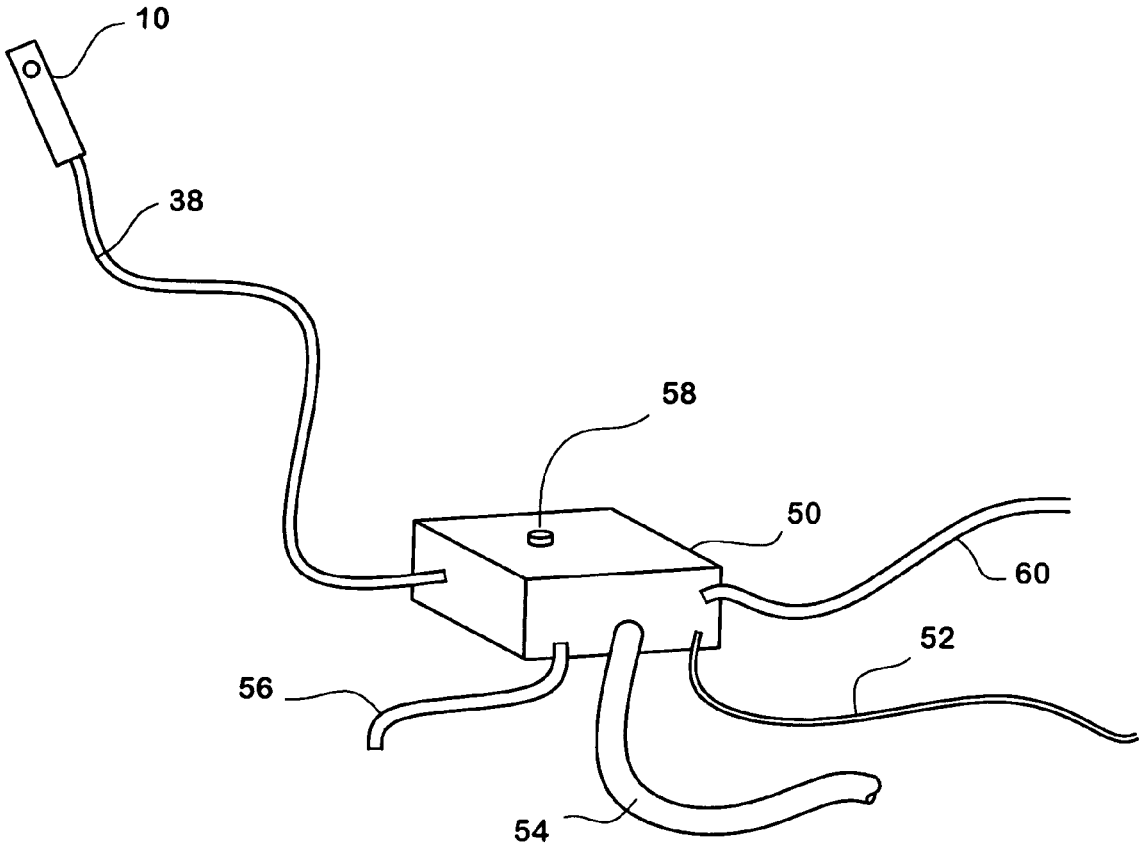
FIG. 3 is a perspective view of the invention, in conjunction with a base unit.

FIG. 3 shows the microphone 10 associated with a base unit 50, to which it is connected by the coaxial gas conduits. The base unit has a power supply cord 52, a flexible exhaust duct 54, and a flexible condensate tube 56. Item 58 is a fill cap for particle or vapor generator fluid, and numeral 60 identifies the flexible output signal wiring.

In operation, particle-bearing gas or a vapor of droplets is passed through the particle-bearing gas flexible supply tube housed within the flexible return vent tube attached to the base unit. Spent particle-bearing gas or vapor is directed to a designated safe location via the flexible exhaust duct and any liquid waste is carried to a designated safe location via the flexible condensate tube.

The base unit is filled with source liquid for the particle-bearing gas or vapor generator via the fill cap for particle or vapor generator fluid. The unit is powered via its power supply cord, connected to a suitable source. Audio signals leave the base unit via the flexible output signal wiring.

Figure 4:
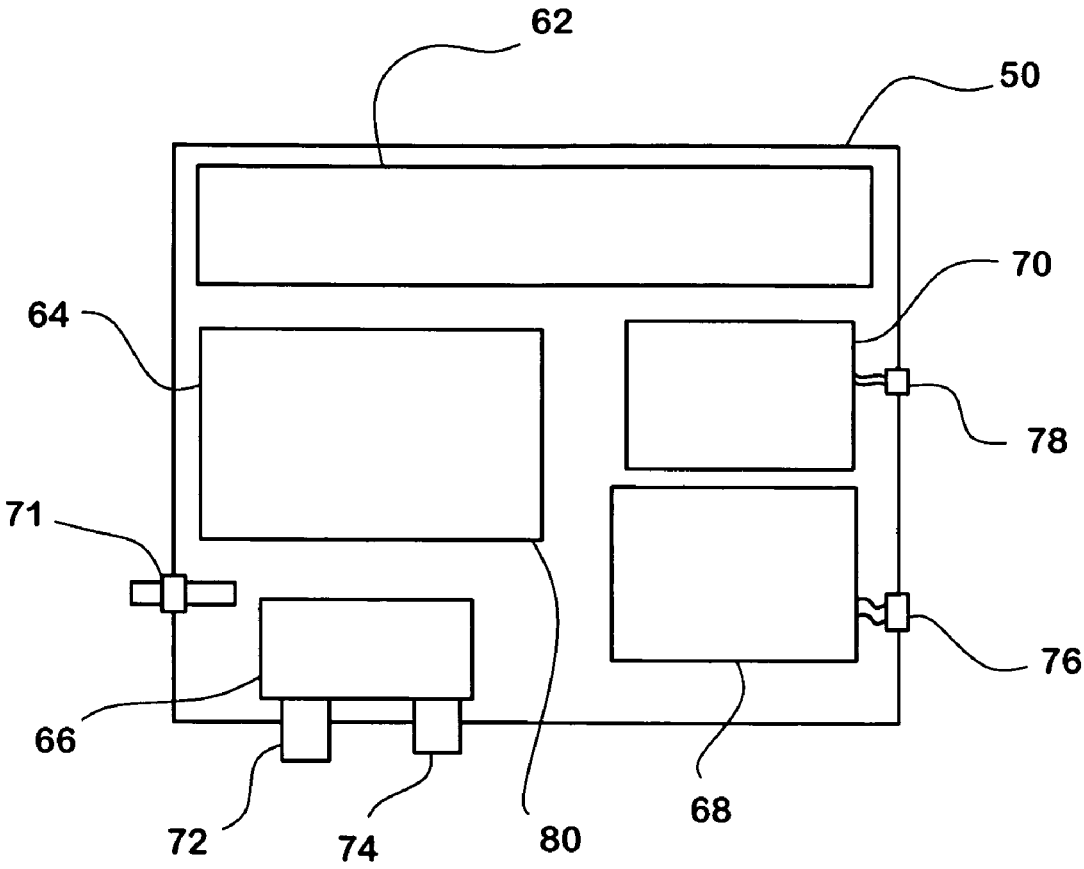
FIG. 4 is a schematic of the base unit itself.

FIG. 4 shows the base unit in greater detail. It includes a fluid tank 62, a particle-bearing gas or vapor generator 64, and an exhaust pump or fan 66. Numeral 68 designates an electrical supply circuit board, and item 70 is a signal conditioning, laser and photo-sensor control circuit board.

The control circuit operates the electromechanical components within the system. Those components are the compressible medium supply pump, the medium heater or vaporizer, the medium return pump, the condensate pump, and any other necessary parts.

The tasks of the control circuit are: (a) to maintain supply pump pressure/flow, (b) to maintain the return pump pressure, (c) to maintain the condensate pump pressure/duty cycle, (d) to maintain the temperature of the supply media, (e) for gas/particulate media, to maintain a constant volumetric flow, and (f) for evaporative media, such as steam or liquid carbon dioxide, to maintain sufficient flow to produce a desired optical density at the detection chamber.

The digital signal processor (DSP) circuit and software has two main functions: detector control and noise reduction. The digitized audio signal will contain system noise as well as signal. The system noise has known characteristics that are dependant on the type of detection media, flow rate, and temperature. Based on a-priori knowledge of the noise signal, a DSP circuit and software will be used to filter out the noise, leaving only the signal of interest.

The DSP circuit and software will control the following parameters of the detection system: laser power, photocell gain, beam diameter (in a moving lens implementation), laser array active elements (if an array of lasers are used), and photocell active area (enabling and disabling elements of the detection array, if an array is used).

The DSP circuit and software output two signals for use by the control circuit, namely (a) RMS power of the detected audio signal and (b) RMS power of the noise.

The multi-connector 71 joins the conduits to the microphone. Other connectors include a condensate tube connector 72, and exhaust duct connector 74, an A.C. power connector 76, and an audio signal output connector 78. The conductors are collected to form a wiring harness 80.

Figure 5:
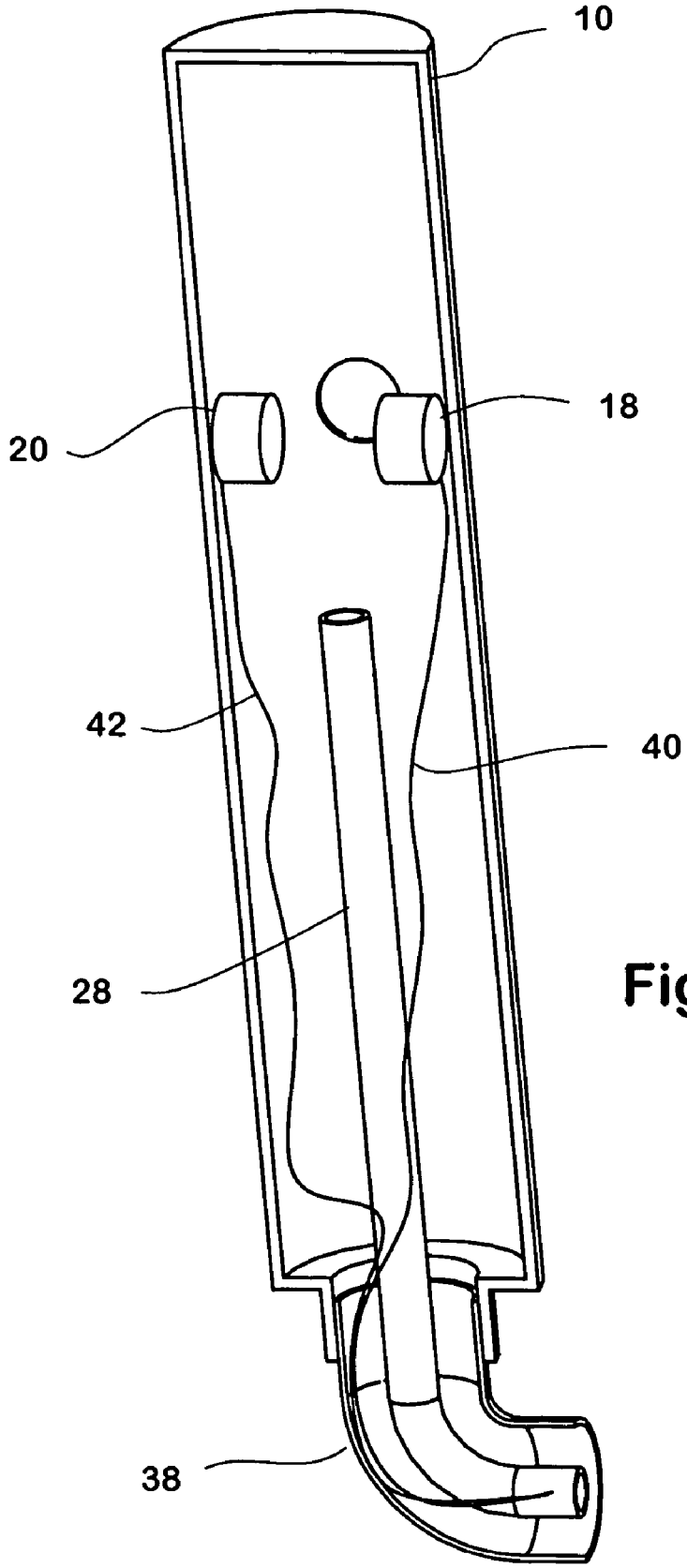
FIG. 5 is a diagrammatic view of a modified form of the invention, lacking an inner chamber.

FIG. 5 shows another version of the invention, in which the detection chamber is omitted, its function being performed by the housing. In this case, return flow of gas is not contemplated; the spent gas simply exits the housing through an exhaust port.

Figure 6:
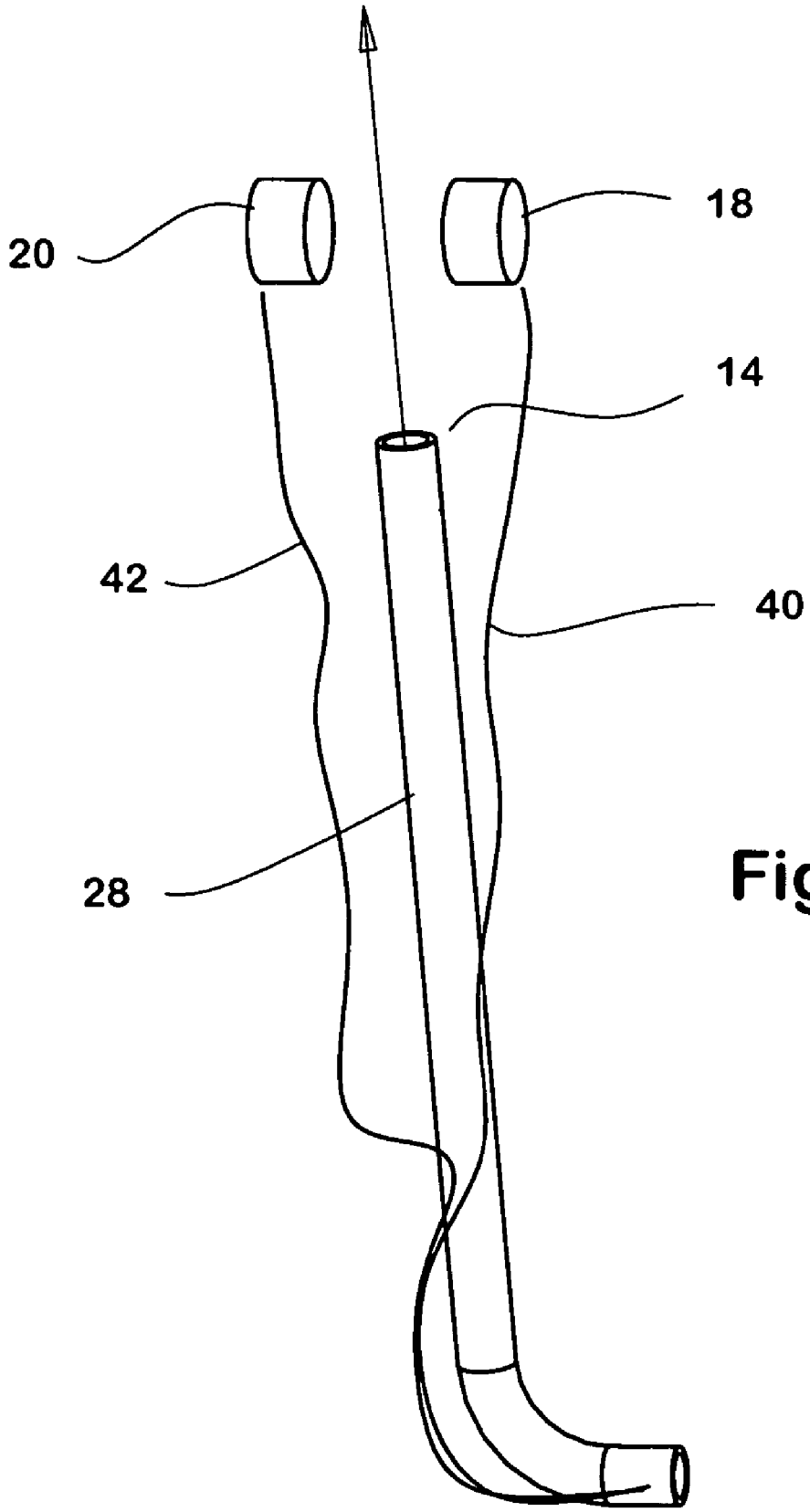
FIG. 6 is a diagrammatic view of another modified form of the invention, lacking any enclosure whatsoever.

FIG. 6 show an open-air version in which even the housing is omitted, the gas stream from the nozzle being completely unconfined. A housing and/or detection chamber will be preferred for most applications, but the open-air version may in some instances be practical.

Figure 7:
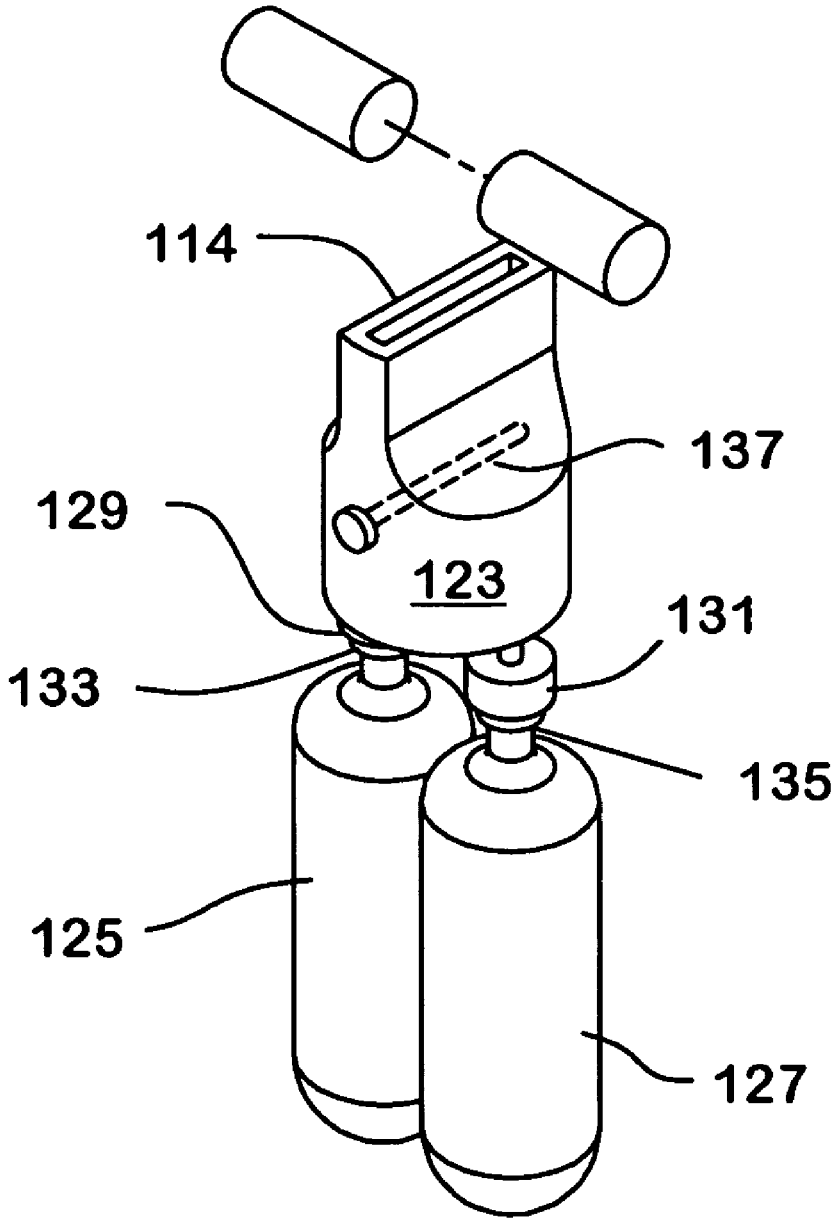
FIG. 7 is a perspective view of the internal components of a hand-held self-contained microphone embodying the invention.

FIG. 7 shows the internal components of a hand-held, self-contained microphone embodying the principles of the invention. The housing and detection chamber are not shown in the drawing. As in the other embodiments, this microphone includes a nozzle 114 for emitting a flow of gas containing particles, in this case water droplets, and a light source and optical detector for sensing sound-induced perturbations in the gas flow. Here, the nozzle is integrated with a mixing chamber 123 which is fed with water from a pressurized water cartridge 125, and gas under pressure from a liquefied gas cartridge 127. The flow of fluids from the tanks are regulated by electrically-controlled metering valves 129,131 attached to the tanks by couplings 133, 135 respectively. Within the chamber, there is a heating element 137 to raise the temperature of the components if necessary to prevent freezing of the water droplets. The microphone and heater may be powered by batteries, not shown in the drawing.

Figure 8:
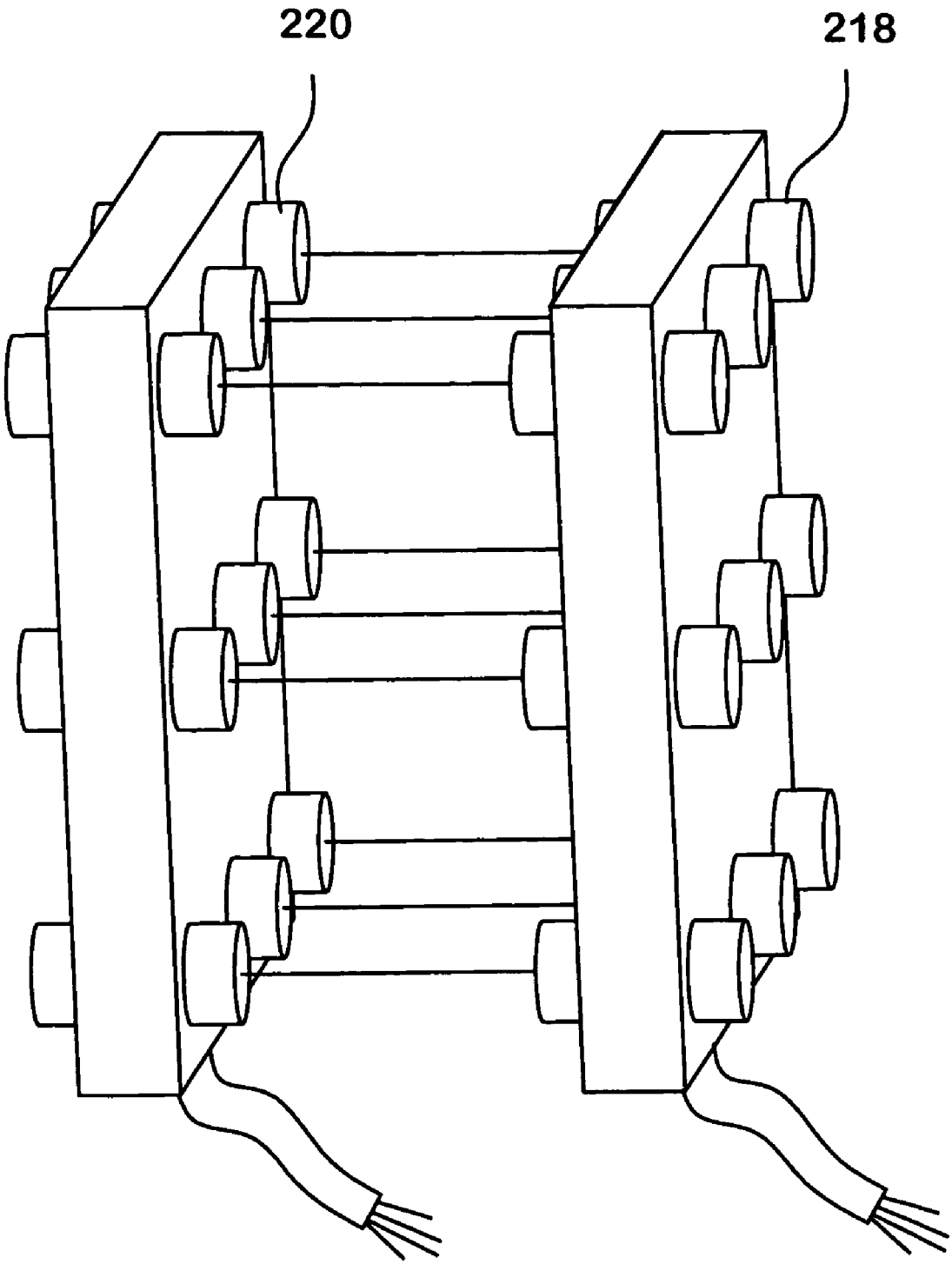
FIG. 8 is a perspective view of an alternative form of the photo sensor element of the invention.

FIG. 8 shows an alternative form of the photo-sensor of the invention, in which, instead of a single sensor, there are plural sensors 220, preferably arranged in a two-dimensional array, opposite a corresponding number of lasers 218 or other light sources. It may also be possible to have arrangements in which the number of sources and sensors are unequal, for example just one light source and multiple sensors. An advantage of multiple light paths is that the composite signal would be less affected by anomalies in the gas flow. Methods for combining signals from multiple sensors operating in parallel are well known and therefore are not discussed in detail here.

Some implementations of this invention will not require an exhaust duct, because the vapor will return as a liquid. There are some problems with using only water, in which steam is the vapor, but that could work as well. In other implementations, there will be no condensation, since all the return will be gaseous. Additionally, the electrical circuit boards could be combined into one high and low voltage combination board.

The amount of gain in the photo-sensor can be set automatically, as in most conventional microphone designs. Or, a user control could be provided on the base unit. This is not shown in the drawing.

All conventional microphones have a geometric pattern to their sound pickup. Some are highly directional, like "shotgun" microphones. Others are totally omni-directional, like PCM surface-mounted microphones. High-end professional units have heart-shaped patterns, etc. The pickup pattern of the microphone described herein can be tailored by adjusting the shape of the aperture of the chamber or the shape of the housing.

While in the illustrated preferred forms of this invention, the sound propagation direction, the optical axis, and the gas flow direction are arranged on three orthogonal axes, an orthogonal relationship may not be necessary. For example, an open-air version of the microphone could have the laser in the microphone handle, pointed upwards, parallel with the media stream, and the photo-sensor located within the stream, on a vertical extension from the handle. This version is not illustrated.

The absolute sensitivity of most conventional microphones is designed-in; they are not adjustable. Because the particulate flow detection microphone uses a laser and a photo-sensor, sensitivity can be adjusted by the user via control of the laser power and/or the noise floor of the photo-sensor. The drawings do not show such user controls.

Inasmuch as the invention is subject to modifications and variations, the invention should be measured by the claims that follow. The examples depicted and described are not to be construed as limitations on the invention in its broadest sense.

I claim:

1. A microphone comprising means for supplying a partially transparent compressible medium at a location, an optical transducer for detecting opacity of the medium as a function of time at said location and providing an output signal representative of said opacity function, and means for causing the medium to flow continuously past said location, wherein the flow causing means comprises a medium supply, a conduit leading from the supply to the microphone, and a nozzle upstream of said location, where the flow causing means supplies the medium to said location at a rate sufficient to prevent sonic contamination of said medium at said location, whereby signal corruption by sound wave reflections is prevented.

2. A method of generating an electrical signal representative of sound at a location, comprising steps of causing a partially transparent compressible medium to flow continuously through said location, where the medium transparency is modulated by said sound, causing light to pass through said location toward a photosensor producing an output signal which is modulated by changes in said medium transparency.

3. The method of claim 2, wherein the flow of medium through said location is in a first direction and the light passes through the location in a second direction at a substantial angle to said first direction.

4. The method of claim 2, wherein the flow of medium through said location is in a first direction, the light passes through said location in a second direction, and the sound is caused to pass through said location in a third direction, said first, second and third directions being substantially orthogonal.

* * * * *